United States Patent [19]

Stevens

[11] 4,110,958

[45] Sep. 5, 1978

[54] EXTRACTION OF CONTENTS FROM ENVELOPES

[76] Inventor: Albert F. Stevens, 303 Somers Ave., Moorestown, N.J. 08057

[21] Appl. No.: 786,229

[22] Filed: Apr. 11, 1977

[51] Int. Cl.[2] ..... B65B 43/30

[52] U.S. Cl. ..... 53/386; 53/381 R

[58] Field of Search ..... 53/381 R, 386, 3

[56] References Cited

U.S. PATENT DOCUMENTS

| | | | |
|---|---|---|---|
| 2,814,488 | 11/1957 | Kipers | 53/386 X |
| 3,430,409 | 3/1969 | Manfredonia et al. | 53/386 X |
| 3,466,837 | 9/1969 | Sturges | 53/381 R X |
| 3,566,578 | 3/1971 | Thorne et al. | 53/386 X |
| 3,884,010 | 5/1975 | Bardo et al. | 53/381 R X |
| 3,979,884 | 9/1976 | Russell | 53/381 X |

*Primary Examiner*—Travis S. McGehee

*Attorney, Agent, or Firm*—Weiser, Stapler & Spivak

[57] ABSTRACT

An additional, sharper curvature is imparted to the curved side of a spread-open envelope at the contents extraction site. This "unsticks" contents which may have clung to that side.

9 Claims, 3 Drawing Figures

FIG. 1
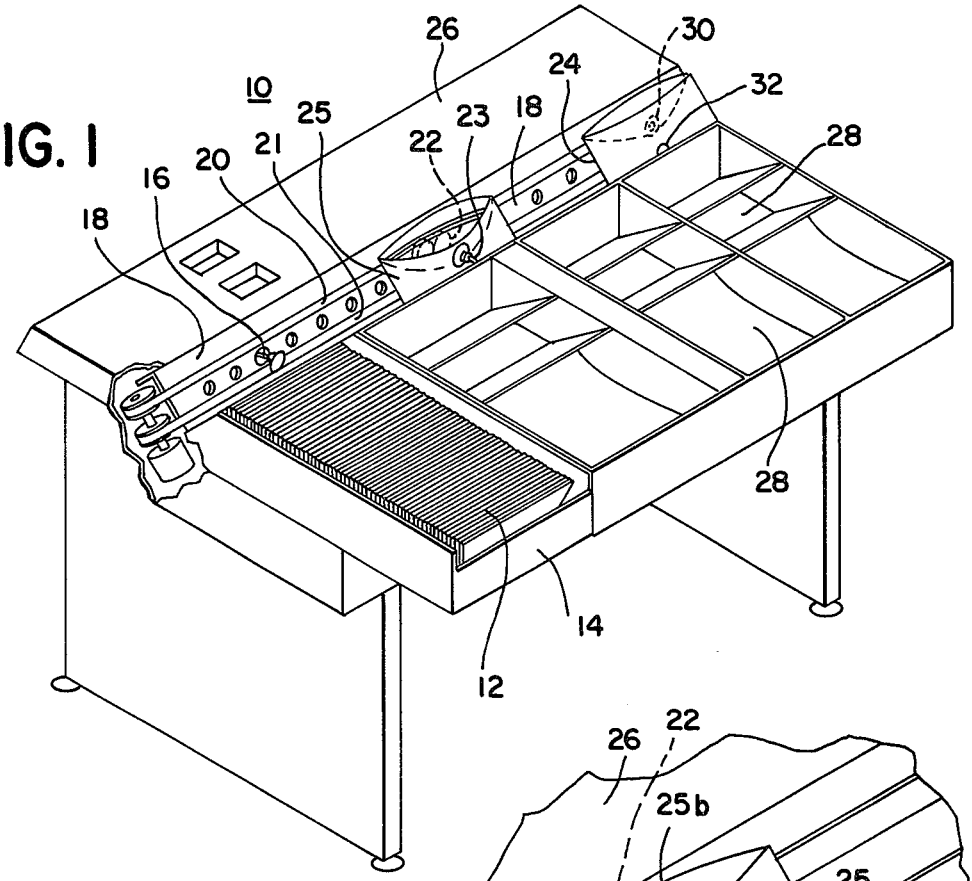
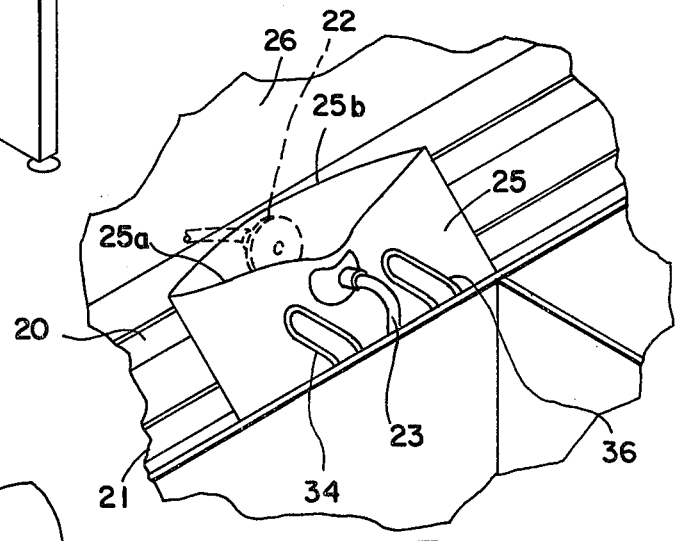
FIG. 2
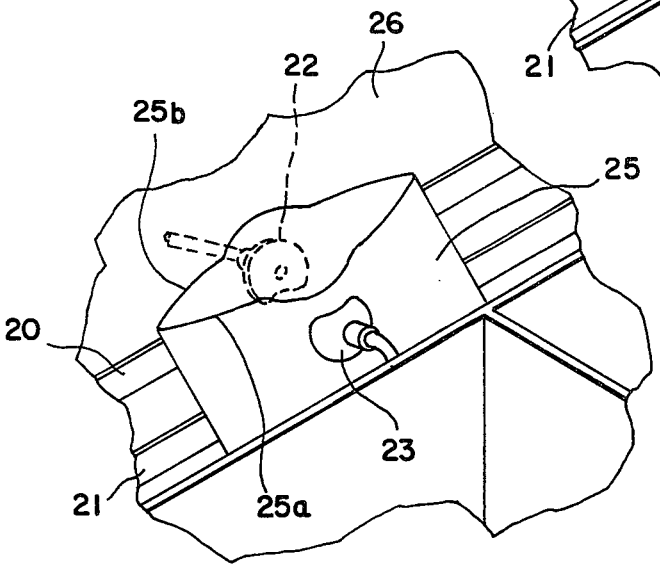
FIG. 3

EXTRACTION OF CONTENTS FROM ENVELOPES

The invention relates to further improvements in machinery which assists in the removal of the contents from envelopes.

It is known that there are many situations in which it is desirable to empty a large number of envelopes of their contents in a short time. Such a situation is encountered, for example, in mail order businesses, where large numbers of envelopes containing order forms for the business' products are received, and must be processed as rapidly and efficiently as possible. A similar situation prevails in the offices of banks, utilities, and other establishments where large numbers of envelopes arrive, containing checks, bill stubs, and so forth. The foregoing situations are cited purely by way of example, and many others, too numerous to list here, also exist.

To speed up and facilitate the task of emptying such envelopes of their contents, various machinery has been devised. One particular type of such machinery brings consecutive envelopes, in rapid succession, to a content extraction position, after the envelopes have previously been slit or otherwise opened along one of their edges. As each such envelope reaches the content extraction position, its opposite sides, or faces, are engaged by suction means, which are then separated, relative to one another. The opposite sides of the envelope are likewise spread apart, thereby creating, along the open edge of the envelope, a gap through which the contents can be extracted.

The actual extraction may be performed either manually or automatically. An example of manual extraction is represented by U.S. Pat. No. 3,979,884, issued Sept. 14, 1976 and assigned to the assignee of the present invention. An example of automatic extraction is represented by U.S. Pat. No. 3,384,252 issued May 21, 1968. In these and other such machinery, involving spreading apart of the envelope along its open edge, there is a definite risk that not only the envelope sides themselves, but also contents of the envelopes may assume the shape of one or the other of the spread-apart envelope sides. These contents then end up in very close juxtaposition to that envelope side after the spreading action has taken place.

When this happens, it becomes more difficult to extract the contents so affected from the envelope. That is because it no longer suffices to reach (manually or automatically) into the middle of the gap between the spread-apart sides of the envelope. Rather, it now becomes necessary to first separate the contents from the envelope side, before extraction can take place.

Failure to perform such prior separation, whether this occurs because the machinery lacks the necessary capability, or because the human operator overlooks the presence of such close-to-the-side contents, gives rise to serious imperfections in the over-all extraction procedure. Contents can be overlooked and discarded together with the presumably empty envelopes. Envelopes must be recycled if it is noticed at a later stage in the processing that the contents have not been extracted.

Perhaps worst of all is the case where one envelope contains more than one related item (e.g. a bill stub and the corresponding payment check) and only one of these is properly extracted while the other remains in the envelope due to the juxtaposition effect noted above. In such a case, the different content items become separated and, even if the non-extraction is later detected and remedied, it can still be extremely difficult and inconvenient to reestablish the proper relationship between the various items which had originally been in the same envelope.

Despite the seriousness of this problem, the prior art appears to have taken comparatively little note of it. Indeed, the only item of prior art showing any concern related to this matter of which applicant is aware is U.S. Pat. No. 3,884,010, issued May 20, 1975. There, an automatic content extraction machine is described, in which the ends of envelopes are slit open, and these envelopes are then caused to bulge open, under the influence of a retractable suction means. The envelopes are then stood on end, in the hope that the contents will drop out under the influence of gravity. This patent does recognize the possibility that envelope contents may stick to the envelope sides, and thereby fail to drop out, as desired. To overcome this effect, the patent proposes to release the suction permitting the envelope to snap back out of the bulging condition caused by the vacuum means, and in the process vibrating the contents to jar them free of the envelope sides. This appears to be a rather unreliable technique for at least two reasons. First, it depends on an uncontrolled effect, which occurs while the envelope sides are free and not confined in any particular position. Secondly, the envelope sides are coming together during this period, following release of the suction, so that any jarring-loose effect will tend to be counteracted by the reclosing movement of the envelope sides.

Accordingly, it is an object of the present invention to provide an improved technique for assisting in the extraction of contents from envelopes.

It is another object of the present invention to provide an improved technique for counteracting a little-recognized problem encountered in machinery for assisting with the extraction of contents from envelopes.

It is another object to provide such an improved technique which counteracts the tendency of envelope contents to remain closely juxtaposed to an envelope side when the envelope is caused to bulge open to permit extraction of its contents.

It is another object to provide such a counteracting technique which acts while the envelope side affected is under positive control.

It is still another object to provide apparatus embodying the foregoing technique.

It is still another object to provide a method embodying the technique.

These and other objects which will appear are achieved by imparting to the envelope side (or sides) of concern in this regard, an additional curvature, in the vicinity of the region in which the envelope is subjected to its maximum spreading open by the suction means. This additional curvature is in the same direction, but both more localized and more pronounced than the curvature produced by the spreading open of the envelope sides.

In one preferred embodiment, the spreading open is performed by entirely conventional suction means applied respectively to the opposite envelope sides at the extraction site and then moved apart to spread the envelope sides open along the previously slit-open edge. In this embodiment, additional stop members are provided near one of the suction means application points. These stop members are so arranged that they impart the desired additional curvature to the envelope side, as the latter comes into contact with the stop members while being spread apart.

In another preferred embodiment, the means for producing the additional curvature are built right into the suction means which produce the spreading open of the envelope at the extraction site.

For further details, reference is made to the discussion which follows, in the light of the accompanying drawings, wherein FIG. 1 is an over-all view of a machine embodying the present invention;

FIG. 2 is a detailed illustration of a portion of the machine of FIG. 1 showing one embodiment of the means for producing the additional envelope side curvature; and FIG. 3 is a detailed illustration of a portion of the machine of FIG. 1 showing another embodiment of the means for producing the additional curvature.

The same reference numerals are used in the several figures to designate similar elements.

Referring to FIG. 1, this shows a machine 10 of known type used in assisting with the removal of contents from envelopes, which have previously been opened along one edge.

A group of these envelopes is shown at 12, stored for processing by machine 10 in bin 14, with the slit edges uppermost. One after another, these envelopes are removed from bin 14 by suction cup 16, which alternately extends into engagement with the nearest envelope in the bin, and retracts back into sloping shelf 18, carrying the envelope with it. Each such envelope is then propelled by conveyor belts 20, 21 along shelf 18 toward the upper right in FIG. 1. The belts are stopped when the envelope reaches a position between suction cups 22, 23. These cups are then moved toward each other until they engage the opposite sides of the envelope, after which they are again moved apart, in the process spreading the sides of the envelope apart. An envelope with its sides spread apart in this manner is shown at 25 in FIG. 1. More will be said later about the structure and operation of this portion of machine 10. For the moment, suffice it to say that this spreading open of the envelope is intended to afford the opportunity for conveniently extracting any contents which may be present in the envelope. To that end, an operator (not shown) may be positioned alongside shelf 26 and this operator would then reach into the spread-open envelope 25 and remove its contents.

Facilities in the form of storage bins 28 are provided to facilitate sorting of these removed contents by the operator.

The suction in suction cups 22, 23 is next released, thereby permitting the envelope to reassume generally the same configuration and position which it had before it was spread open at 25.

The conveyor belts 20, 21 also resume their interrupted movement, carrying the envelope further in the same direction as before, and ultimately carrying it beyond the end of the machine 10, where it is disposed of, e.g. by being allowed to drop into a waste receptacle (not shown).

Before reaching that end of machine 10, the envelope is caused to pass between a combination of photocell 30 and light bulb 32. These in effect "candle" the passing envelope. If they detect the presence of unremoved contents, they stop the belts and the operator can then intervene, inspect the envelope in question, and remove any residual contents.

Further details concerning this type of machine are provided in one of the prior patents mentioned previously in this specification, namely U.S. Pat. No. 3,979,884.

Referring now to FIG. 2, this show in greater detail the portion of the machine 10 of FIG. 1 in the region of envelope 25. As shown in FIG. 2, this portion has two U-shaped protrusions 34, 36, which extend toward envelope 25 in the same direction as suction cup 23. The protrusions 34, 36 may be made of rigid metal wires, or of appropriately shaped plastic. They are spaced apart horizontally by a distance slightly greater than the width of the flexible portion of suction cup 23, thereby permitting that cup to reciprocate between the protrusions toward and away from the envelope. The degree to which they protrude toward the envelope is such that the envelope side 25*a* upon which suction cup 23 acts butts up against these protrusions 34, 36 as the suction cup 23 approaches its most retracted position, while still holding fast to the side 25*a* of the envelope by virtue of the suction effect.

As can be seen in FIG. 2, this causes the envelope side 25*a* to be subjected, in the region between protrusions 34 and 36, to an additional displacement from the position it occupies when the envelope is not spread open, beyond the degree of such displacement which is imparted to the remainder of envelope side 25*a*. In this region of additional displacement, the curvature of side 25*a* will also be different, and specifically more pronounced, than in the remainder of the envelope side.

This more pronounced curvature creates a tendency for any envelope contents, which may be juxtaposed to the interior of side 25*a* as it is caused to assume an increasingly spread open position in response to retraction of suction cup 23, to become separated from that envelope side, and to assume a more centered position within the spread-open envelope 25.

While not wishing to be bound by this explanation, it is thought that the inherent tendency for envelope contents to "stick" to the envelope interior during spreading open is due either to the suction effect from suction cup 23, which penetrates to some degree through envelope side 25*a* and affects its contents, or to inherent adhesion effects between envelope and contents, or to a combination of these effects. Be that as it may, the imparting of the additional local curvature to envelope side 25*a* by the combined effect of suction cup 23 and protrusions 34, 36, creates a counteracting effect, which tends to "unstick" these contents and release them for return to a more normal, undisplaced condition within envelope 25.

Referring now to FIG. 3, this again shows in greater detail the same portion of the machine 10 of FIG. 1, but in terms of a different embodiment of the present invention.

In this embodiment of FIG. 3, there is again shown envelope 25, spread open by suction cups 22, 23. However, in this instance, not only side 25*a* attached to cup 23, but also side 25*b* attached to cup 22 exhibits an additional displacement, and an accompanying more pronounced curvature, in the vicinity of the respective suction cups.

In the embodiment of FIG. 3, this extra curvature is imparted, not by separate protrusions engaging the envelope side as was the case in the embodiment of FIG. 2, but rather by the suction cups themselves.

To that end, each cup is so constructed that its rim normally tends to assume a cup shape having a circumferentially non-uniform curvature, this curvature being more pronounced in the horizontal than in the vertical direction. At the same time, this cup rim is made sufficiently flexible that it can seat against the envelope side when initially extended toward the envelope while the latter is still closed. The flexing of the cup necessary to produce such seating is aided by the fact that the seating pressure exerted by a given cup on one envelope side is resisted by the seating pressure simultaneously applied by the other cup to the opposite side of the envelope. This means that seating on the envelope sides can be accomplished even though the cup rims have the degree of stiffness necessary to enable them to reassume their built-in circumferentially non-uniform curvature, as they draw apart during spreading open of the envelope 25.

The locally accentuated curvature of envelope sides 25*a* and 25*b*, which results when the sides are spread apart and the suction cups reassume their built-in shapes, tends to "unstick" envelope contents from the sides, allowing them to return to their natural shapes and positions within spread-open envelope 25.

It will be understood that other variations may be made without departing from the inventive concept.

For example, in FIG. 2, additional, accentuated curvature is shown imparted only to envelope side 25*a* engaged by suction cup 23. This is because the natural reach of an operator's hand into the spread open envelope 25 will tend to grasp contents adjoining the opposite side (side 25*b*). This will not be the case for side 25*a*. It is therefore not always equally important to provide mechanical content separating means for side 25*b* as for side 25*a*. However, if desired, such separating means in the form of protrusions similar but opposite to protrusions 34, 35 could also be provided. Care would have to be exercized that these do not interfere with the movement of envelopes by belts 20, 21. They would therefore preferably also alternately extend out from and retract back into sloping shelf 18, extending when an envelope is stopped at 25, and retracting when the envelopes are in motion on belts 20, 21.

Also in FIG. 2, the protrusions 34, 36 are shown spaced far enough apart to permit unobstructed movement of suction cup 23. However, these protrusions could also be spaced closer together, so as to actually bend the rim of the cup, at its horizontal extremities, and thereby imparting to this rim a greater horizontal than vertical curvature. In turn, the distorted cup rim would then impart the desired added curvature to envelope side 25*a*. In that sense, the equivalent effect would be produced as in FIG. 3, in which such distortion of the suction cup rim takes place by the inherent construction of the cup.

It should also be understood that terms such as "curvature" and "additional curvature" as used in relation to the present invention are not intended to be limited to particular geometric patterns, such as arcs of circles, segments of ellipses, or the like. Rather, these terms are used broadly to denote any bulging, or bowed shape which is inherently assumed by the kind of flexible material of which envelopes are customarily made, under the influence of the spreading devices, used. These bulging or bowed shapes may also include angularities, for example at the edges of the suction cups. All such generally bowed or bulging configurations, including angularities, are intended to be encompassed by the curvature terminology.

The following should also be understood. The inventive technique is particularly advantageous when utilized with envelopes which have been opened along one edge (as shown in the drawings) or even along two opposing edges (as shown in U.S. Pat. No. 3,884,010). However, certain aspects of this technique are also useful in other situations.

Consider, for example, the situation in which an envelope is opened on three sides, and then spread open by suction means acting on the opposite faces of the envelope. In that case, there may be no bulging or bowing of the spread-apart envelope faces since they are no longer held together at their opposite ends. Nevertheless, the contents "sticking" phenomenon may still occur. Here, too, the invention finds application, in that it teaches the imparting of a curvature, to what may otherwise be a flat (uncurved) envelope side, in order to "unstick" contents from the interior face of the envelope side.

Indeed, this technique even has application in cases where there is no double sided envelope at all. It may be desirable to displace by suction means the top sheet of a stack of two or more in order to remove an underlying sheet. There, too, the sticking effect may tend to frustrate this procedure. By imparting a local curvature to the top sheet, the one below becomes "unstuck" and can be removed.

I claim:

1. In a machine for facilitating the extraction of contents from an envelope and employing suction means for engaging the opposite sides of the envelope and for displacing at least one side to spread the envelope open, thereby also imparting to each side a first predetermined curvature:

means for imparting to a portion of at least one of the sides a second curvature while the envelope is being spread open, said second curvature being more pronounced and in the same direction as the first curvature imparted to that side.

2. The machine of claim 1 further comprising means for also imparting to the opposite side of the envelope a second curvature while the envelope is being spread open, said second curvature being also more pronounced and in the same direction as the first curvature imparted to the second side.

3. The machine of claim 1 wherein the first curvature imparting means comprises means for displacing the suction means with the engaged envelope side, and the second curvature imparting means comprises means for limiting the displacement of portions of the envelope side distant from the suction means to produce the second curvature.

4. The machine of claim 3 wherein the displacement limiting the means comprises means positioned in the path of the envelope side as it is displaced by the suction means.

5. The machine of claim 4 wherein the means positioned in the path is stationary.

6. The machine of claim 5 wherein there are at least two stationary limiting means positioned on opposite sides of the suction means.

7. The machine of claim 6 wherein the limiting means are spaced far enough apart to permit passage of the suction means between them.

8. The machine of claim 3 wherein the displacement limiting means is part of the suction means.

9. The machine of claim 8 wherein the second curvature imparting means includes a flexible rim for seating the suction means against the engaged envelope side, the rim being made so as to inherently assume a circumferentially non-uniform curvature, and the rim being made with sufficient flexibility to at least partially flatten when pressed against the envelope side before its displacement, and with a sufficiently strong inherent tendency toward the non-uniform curvature to at least tend to reassume the non-uniform curvature during displacement of the envelope side.

* * * * *